United States Patent [19]

Masaki et al.

[11] 3,982,393

[45] Sept. 28, 1976

[54] INTERNAL COMBUSTION ENGINE EXHAUST CLEANING METHOD AND SYSTEM

[75] Inventors: Kenji Masaki; Masaaki Saito, both of Yokohama, Japan

[73] Assignee: Nissan Motor Company Limited, Yokohama, Japan

[22] Filed: Dec. 12, 1974

[21] Appl. No.: 531,986

[30] Foreign Application Priority Data

Dec. 21, 1973 Japan ..... 48-143296

[52] U.S. Cl. ..... 60/274; 60/282; 60/285; 123/59 PC; 123/32 EA

[51] Int. Cl.[2] ..... E02B 75/10

[58] Field of Search ..... 60/274, 282, 285; 123/127, 52 M, 59 PC, 32 EA

[56] References Cited

UNITED STATES PATENTS

| | | | |
|---|---|---|---|
| 3,708,980 | 1/1973 | Truxell | 60/301 |
| 3,785,153 | 1/1974 | Schwing | 60/282 |
| 3,827,237 | 8/1974 | Linder | 60/274 |

*Primary Examiner*—Douglas Hart

[57] ABSTRACT

Rich and lean air-fuel mixtures can be alternately supplied into engine cylinders in response to engine load to effectively operate an afterburner.

14 Claims, 4 Drawing Figures

INTERNAL COMBUSTION ENGINE EXHAUST CLEANING METHOD AND SYSTEM

The present invention relates to a method of cleaning exhaust gases discharged from an internal combustion engine and a system for carrying out the method.

It is well known in the art, that the concentration of nitrogen oxides in the exhaust gases discharged from the internal combustion engine reach a peak where air and fuel mixture are combusted in the engine with the proportion of air-to-fuel ratio approximating the stoichiometric air-to-fuel ratio of 16 : 1. The concentration of nitrogen oxides thus diminish as the air-to-fuel ratios of the mixtures are at values lower or higher than the stoichiometric air-to-fuel ratio or, in other words, the mixtures are rendered richer or leaner.

It has already been proposed that a multi-cylinder internal combustion engine be operated on both a richer air-fuel mixture supplied into about half the number of total cylinders of the engine and a leaner air-fuel mixture supplied into the remaining cylinders. The exhaust gases discharged from all the engine cylinders are then introduced into an afterburning means such as an afterburner in which the gases are mixed with each other and afterburned for oxidation of harmful constituents therein.

However, in the prior art, difficulties have been encountered in that the temperature in the afterburner is not raised sufficiently high for efficient functioning and therefore gases discharged from the afterburner contain considerable amounts of harmful constituents during low load engine operation or immediately after engine starting. This results from the fact that exhaust gases introduced into the afterburner do not contain sufficient unburned constituents, e.g. carbon monoxide and hydrocarbons, which heat the afterburner by combustion within the same.

Accordingly, it is an object of the present invention to provide an improved method and system which will effectively purify exhaust gases from an internal combustion engine equipped with an afterburner by controlling the concentrations of unburned constituents contained in the exhaust gases introduced into the afterburner in response to the engine load.

It is another object of the present invention to provide an improved method and a system by which an internal combustion engine can discharge a relatively high concentration of unburned constituents and introduce them into the afterburner during low engine load operation but which can discharge a relatively low concentration of unburned constituents during medium and high load engine operations.

It is another object of the present invention to provide an improved method and a system by which the temperature in the afterburner is rapidly elevated to efficiently function during low engine load operation and prevented excessive elevation during medium and high load engine operations.

Other objects and features of the improved method and the improved system according to the present invention will become more apparent from the following description taken in conjunction with the accompanying drawings in which.

Figure 1:
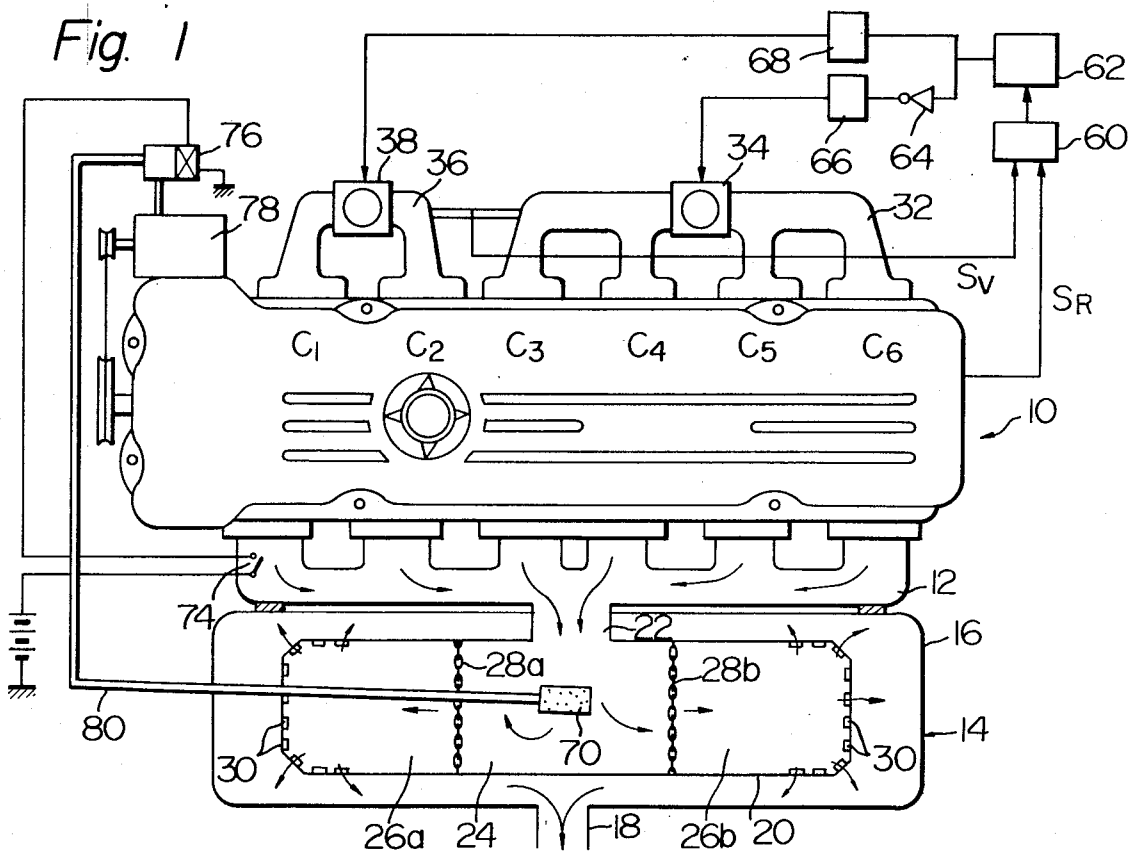
FIG. 1 is a schematic view showing an example of an exhaust cleaning system according to the present invention which employs carburetors as the air-fuel mixture supply means.

An example of an exhaust gas cleaning system which this invention consists of is illustrated in FIG. 1, the system being used for cleaning the exhaust of an internal combustion engine which is generally represented by numeral 10 and being connected thereto. The engine 10 has six cylinders $C_1$ to $C_6$ (only their locations shown) of which four cylinders $C_3$ to $C_6$ more than half the number of total cylinders, form, in this instance, a first group of cylinders while the other two cylinders $C_1$ and $C_2$ form a second group of cylinders. The exhaust ports (no numerals) of the cylinders communicate through an exhaust manifold 12 with an afterburner 14 which afterburns and purifies gases discharged from the cylinders. The afterburner 14 includes a longitudinally extending outer casing 16 having an outlet 18 for discharging purified gases into the atmosphere. In the outer casing 16 is disposed a longitudinally extending inner casing 20 having an inlet 22 connected with the exhaust manifold 12 for feeding gases from the cylinders thereinto. The inner casing 20 defines therein a mixing chamber 24 at its central portion for mixing gases discharged from the cylinders and two opposed reaction chambers **26*a* and 26*b* at its both end portions for afterburning the gases mixed in the mixing chamber 24. The chambers 24, 26*a* and 26*b* are separated from each other by two suitable porous partition walls 28*a* and 28*b*. The two reaction chambers 26*a* and 26*b* communicate through a plurality of openings 30 formed through both end portions of the inner casing 20 with a chamber defined between inner casing 20 and the outer casing 16.** While a particular form of afterburner has been shown and described, other suitable afterburners may be employed if desired.

The intake ports (not shown) of the first group of engine cylinders $C_3$ to $C_6$ communicate through an intake manifold 32 with a first carburetor 34 supplying an air-fuel mixture into the cylinders while the intake ports (not shown) of the second group of cylinders $C_1$ and $C_2$ communicate through another intake manifold 36 with a carburetor 38 for supplying another air-fuel mixture into the cylinders. The first and second carburetors 34 and 38 are constructed as illustrated in FIG. 2.

Figure 2:
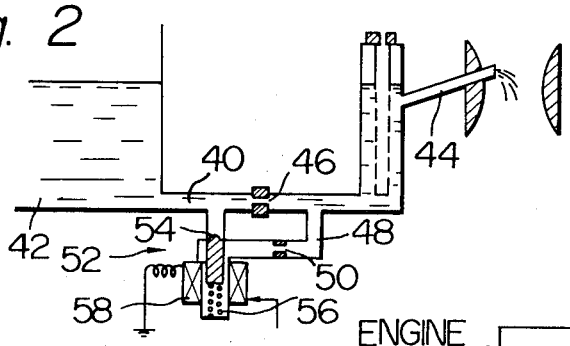
FIG. 2 is a longitudinal sectional view of a carburetor employed in the system shown in FIG. 1.

As shown in FIG. 2, each of carburetors 34 and 38 includes a main fuel passage 40 which connects a float chamber 42 to a main discharge nozzle 44. The main fuel passage 40 has therein a main jet 46 which restricts the amount of fuel flowing through the passage 40. An auxiliary fuel passage 48 is disposed to connect the upstream and downstream portions of the main jet 46. In the auxiliary fuel passage 48, an auxiliary jet 50 is disposed for restricting the amount of fuel flowing through the passage 48. These carburetors 34 and 38 are such arranged as to alternately prepare a rich air-fuel mixture when fuel to be discharged from the main nozzle 44 is supplied through both the main and auxiliary fuel passages 46 and 48 and a lean air-fuel mixture when the fuel to be discharged from the main nozzle 44 is supplied through only the main fuel passage 40 with closure of the auxiliary fuel passage 48. The rich and lean air-fuel mixtures are regulated to make a first air-fuel mixture richer than stoichiometric mixture and a second air-fuel mixture leaner than stoichiometric mixture by employing the suitable sizes of the main and auxiliary jets 46 and 50.

Disposed in the auxiliary fuel passage 48 of each of the carburetors 34 and 38 is an electromagnetic flow control valve 52 which forms part of an actuating means for controlling the carburetors 34 and 38. The control valve 52 is so arranged that its movable core 54 is upwardly biased by the action of a helical spring 56 to close the passage 48 when the coil 58 is de-energized and move the core 54 downwardly against the biasing force of the spring 56 to open the passage 48 when the coil 58 is energized.

The control valves 52 connected with the carburecors 34 and 38 are operated to control the air-fuel mixture supplied into the engine cylinders in accordance with the present invention in a manner illustrated hereinafter. Referring again to FIG. 1, a load sensor 60 functions to sense an engine load signal $S_v$ representing the intake manifold vacuum and another signal $S_r$ representing engine speed and generate an electrical signal indicative of the two engine load signals. The signal from the load sensor 60 is transmitted to a comparator 62. The comparator 62 alternately generates a first logic signal "0" when the signal from the load sensor 60 is below a predetermined level (during low load engine operation) and a second logic signal "1" when the signal is above the predetermined level (during medium and high load engine operations). The logic signal is transmitted to a first amplifier 66 through an inverter 64 for inverting the signal. Additionally, the logic signal is also transmitted directly to a second amplifier 68. Accordingly, when the first logic signal "0" is transmitted from the comparator 62, the first amplifier 66 amplifies the logic signal from the inverter 64 to produce an energizing signal $S_e$ for energizing the electromagnetic coil 58 while the second amplifier 68 amplifies the logic signal to produce a de-energizing signal $S_d$ for de-energizing the electromagnetic coil 58. However, when the second logic signal "1" is transmitted from the comparator 62, the first amplifier 66 produces a de-energizing signal $S_d$ while the second amplifier 68 produces the energizing signal $S_e$. Therefore, the first carburetor 34 supplies the first air-fuel mixture into the first group of engine cylinders and the second carburetor 38 supplies the second air-fuel mixture into the second group of engine cylinders during low load engine operations. On the contrary, the first carburetor 34 supplies the second air-fuel mixture into the first group of engine cylinders and the second carburetor 38 supplies the first air-fuel mixture into the second group of engine cylinders during medium and high load engine operations.

Designated by reference numeral 70 is a secondary air injection nozzle which is adapted to supply secondary air into the mixing chamber 24 of the afterburner 14 in a following manner. When the temperature of the gases discharged from the engine 10 is relatively low, a thermo-switch 74 is closed to transmit the electric current from a battery to the solenoid cell of a valve 76 to open the valve 76. Thus secondary air from an air pump 78 flows through the open valve 76 and a secondary air conduit 80 to the secondary air injection nozzle 70.

As will be apparent from the above, when the ignition sequence of the engine cylinders is set at $C_1$–$C_5$–$C_3$–$C_6$–$C_2$–$C_4$, combustion sequence of the air-fuel mixtures in the engine 10 is S-F-F-F-S-F during low load engine operation while F-S-S-S-F-S during medium and high load engine operation, where F and S represent the first and second air-fuel mixtures respectively.

Thus, with this arrangement of the exhaust cleaning system, gases containing relatively high concentrations of unburned constituents are discharged from the engine 10 into the afterburner 14 and therefore the temperature in the afterburner 14 is rapidly elevated to effect function of the afterburner during low load engine operation or immediately after starting the engine.

However, gases containing relatively low concentrations of unburned constituents are discharged from the engine 10 and therefore the afterburner 14 is prevented from overheating during medium and high load engine operations. Additionally, this is effective from the view point of fuel economy.

Figure 3:
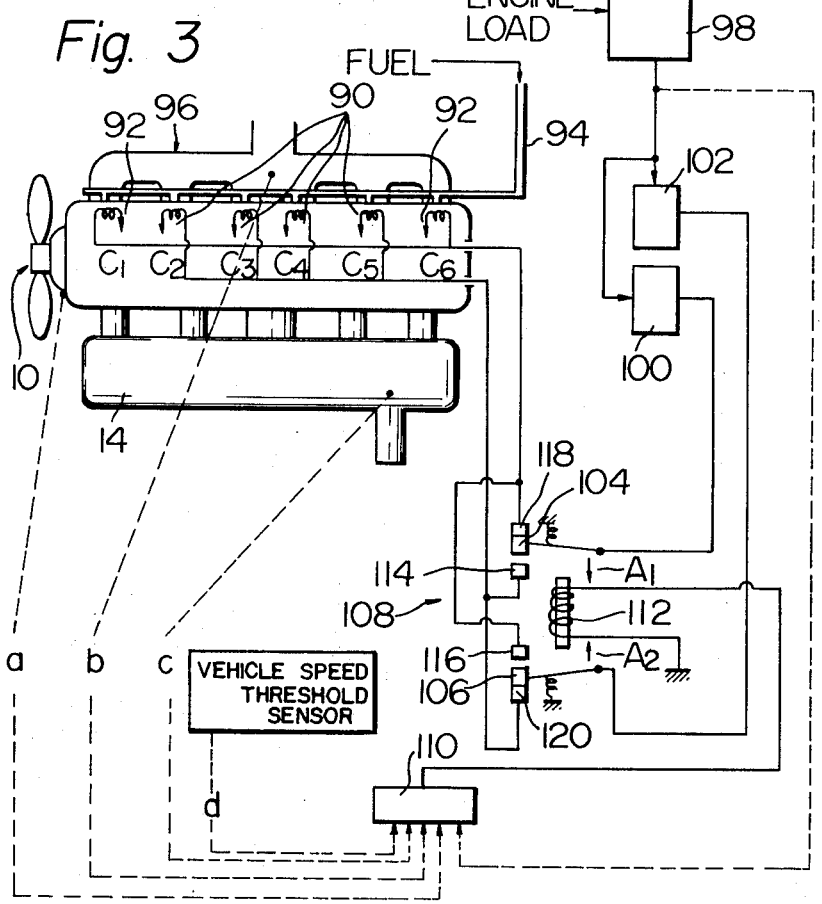
FIG. 3 is a schematic view showing another example of an exhaust cleaning system according to the present invention which employs an electronically controlled fuel injection system as the fuel supply for the air-fuel mixture supply means.

FIG. 3 illustrates another example of the exhaust gas cleaning system similar to that shown in FIG. 1 with the exception that an electronically controlled fuel injection system connected with an air induction system supplies air-fuel mixture into the engine cylinders of the engine 10. The engine 10 has a first group of engine cylinders consisting of four engine cylinders $C_2$ to $C_5$ (only their locations shown) or more than half the number of total cylinders and a second group of engine cylinders consisting of two cylinders $C_1$ and $C_6$ (only their locations shown). The exhaust ports (no numerals) of the engine cylinders communicate through a plurality of exhaust conduits (no numerals) with an afterburner 14 similar to that shown in FIG. 1.

The electronically controlled fuel injection system includes a first group of fuel injection devices 90 which are disposed in the intake ports (not shown) corresponding to the first group of engine cylinders $C_2$ to $C_5$ and a second group of fuel injection devices 92 which are disposed in the intake ports (not shown) corresponding to the second group of engine cylinders $C_1$ and $C_6$. Each of the fuel injection devices has, as usual, a fuel injection nozzle (not shown) for injecting fuel into the corresponding intake port and a solenoid valve (not shown) associated with the injection nozzle. The solenoid valve is, as usual, adapted to open and allow injection of pressurized fuel from a fuel conduit 94 through the injection nozzle when energized. The fuel injection device is designed in connection with the air induction system 96 to supply the first air-fuel mixture into the corresponding engine cylinder when its solenoid valve is energized for a relatively long period of time and to supply the second air-fuel mixture when its solenoid valve is energized for a relatively short period of time.

Solenoid valves of the fuel injection devices 90 and 92 are operated to control the air-fuel mixtures to be supplied into the engine cylinders in a manner illustrated hereinafter. A load sensor or an electronic computing circuit 98 is adapted to compute the required amount of fuel to be injected through the fuel injection devices 90 and 92 in accordance with the engine load using as parameters the amount of air inducted and other engine operating variables and generates an electrical signal indicative of the required amount of fuel to be injected. The signal from the computing circuit 98 is transmitted to a first pulse generator 100 for generating a first pulse signal having relatively wide pulse and to a second pulse generator 102 for generating a second pulse signal having relatively narrow pulse width. The pulse generators 100 and 102 are respectively electrically connected to a first movable contact 104 and a second movable contact 106 of an electromagnetic relay 108.

The electrical signal from the computing circuit 98 is also transmitted to a control device 110 which is adapted to alternatively energize a coil 112 of the relay 108 when the signal from the circuit 98 is below a predetermined level and de-energize the coil 112 when the signal is above the predetermined level. The timing of energizing or de-energizing of the coil 112 may further be modified by feeding to the control device 110 signals *a*, *b*, *c* and *d* which represent respectively engine speed, intake manifold vacuum, exhaust gas temperature, and vehicle speed.

When the coil 112 of the relay 108 is energized (during low load engine operation), the movable contacts 104 and 106 are biased to the directions indicated by arrows $A_1$ and $A_2$ respectively and contact with stationary contacts 114 and 116 respectively. Accordingly, the first pulse generator 100 is connected to the solenoid valves of the first group of fuel injection devices 90 to energize their solenoid valves for a relatively long period of time in response to the first pulse signal transmitted from the first pulse generator 100 while the second pulse generator 102 is connected to the solenoid valves of the second group of fuel injection devices 92 to energize their solenoid valves for a relatively short period of time in response to the second pulse signal transmitted from the second pulse generator 102.

On the contrary, when the coil 112 of the relay 108 is de-energized (during medium and high load engine operations), the movable contacts 104 and 106 are biased by means of springs (no numerals) and contact with stationary contacts 118 and 120 respectively. Accordingly, the first pulse generator 100 is connected to the solenoid valves of the second group of fuel injection devices 90 to energize their solenoid valves for a relatively long period of time in response to the first pulse signal while the second pulse generator 102 is connected to the solenoid valves of the first group of fuel injection devices 90 to energize their solenoid valves for a relatively short period of time in response to the second pulse signal.

In this instance, when the ignition sequence of the engine cylinders is $C_1$-$C_5$-$C_3$-$C_6$-$C_2$-$C_4$, the sequence of the air-fuel mixtures into the engine 10 is S-F-F-S-F-F during low load engine operation and F-S-S-F-S-S during medium and high load engine operations, where F and S represent the first and second air-fuel mixtures respectively.

Figure 4:
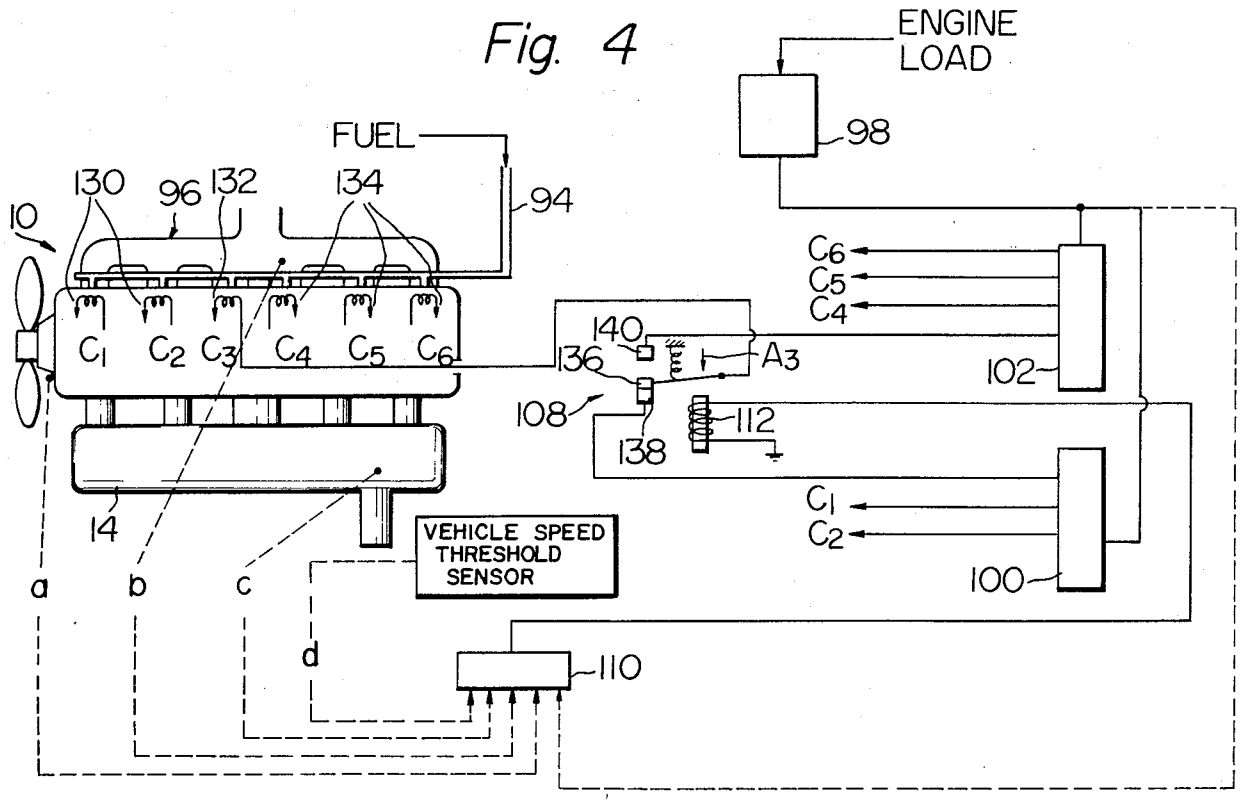
FIG. 4 is a schematic view similar to FIG. 3 but shows a further example of an exhaust cleaning system according to the present invention.

FIG. 4 illustrates an example of an exhaust cleaning system similar to that shown in FIG. 3 with the exception that one cylinder is alternately supplied with the first or second air-fuel mixture, while two cylinders constantly receive the first air-fuel mixture and the remaining three cylinders constantly receive second air-fuel mixture. In this instance, reference numerals and characters like those in FIG. 3 designate corresponding parts, units and matters and therefore illustrations of those have been omitted for the purpose of brevity of description.

The electronically controlled fuel injection system of this example includes two fuel injection devices 130 which are disposed in the intake ports (not shown) corresponding to engine cylinders $C_1$ and $C_2$, a fuel injection device 132 which is disposed in the intake port (not shown) corresponding to an engine cylinder $C_3$, and three fuel injection devices 134 which are disposed in the intake ports (not shown) corresponding to engine cylinders $C_4$ to $C_6$. Each of the fuel injection devices 130, 132 and 134 is disposed similarly to that shown in FIG. 3.

The two fuel injection devices 130 are permanently connected to the first pulse generator 100 to supply the first air-fuel mixture into the corresponding engine cylinders $C_1$ and $C_2$ while the three fuel injection devices 134 are permanently connected to the second pulse generator 102 to supply the second air-fuel mixture into the corresponding engine cylinders $C_4$ to $C_6$. However, the fuel injection device 132 is alternately connected to the first and second pulse generators 100 and 102 to alternately supply the first and second air-fuel mixtures respectively into the corresponding engine cylinder $C_3$ in response to the engine load.

In operation, when the coil 112 of the electromagnetic relay 108 is energized by the action of the control device 110 (during low load engine operation), a movable contact 136 connected to the fuel injection device 132 is biased to the direction of arrow $A_3$ against the biasing force of a spring (no numeral) so as to contact with a stationary contact 138 connected to the first pulse generator 100 and therefore the first air-fuel mixture is supplied into the engine cylinder $C_3$ in addition to cylinders $C_1$ and $C_2$ or half the number of total cylinders. When the coil 112 is de-energized by the action of the control device 110 (during medium and high load engine operations), the movable contact 136 is biased by the action of the spring so as to contact with a stationary contact 140 connected to the second pulse generator 102 and therefore the second air-fuel mixture is supplied into the engine cylinder $C_3$ in addition to cylinders $C_4$ to $C_6$.

In this instance, when ignition sequence of the engine cylinders is set at $C_1$-$C_5$-$C_3$-$C_6$-$C_2$-$C_4$, combustion sequence of the air-fuel mixtures in the engine 10 is F-S-S-S-F-S during low load engine operation while it is F-S-F-S-F-S during medium and high load engine operations.

It will be noted that the exhaust cleaning system shown in FIG. 4 is particularly suitable for a stationary internal combustion engine because such a type is mainly operated at medium and high engine loads and stopped infrequently.

Thus, with this arrangement of the exhaust cleaning system shown in FIG. 4, exhaust gases capable of being burned are discharged from the engine 10 into the afterburner 14 during low load engine operation, while gases containing relatively low concentration of the unburned constituents are discharged from the engine 10 and therefore the afterburner 14 is prevented from an excessive rise of the temperature therewithin.

What is claimed is:

1. A method of cleaning exhaust gases from a multicylinder internal combustion engine comprising the steps of:

supplying a first air-fuel mixture richer than stoichiometric mixture into engine cylinders consisting of at least half the number of total cylinders of the engine and a second air-fuel mixture leaner than stoichiometric mixture into the remaining cylinders of the engine during low load engine operation;

supplying the second air-fuel mixture into engine cylinders consisting of more than half the number of total engine cylinders and the first air-fuel mixture into the said remaining engine cylinders during medium and high load engine operation; and afterburning in an afterburner the gases discharged from all the engine cylinders;

whereby the temperature in the afterburner is elevated so that the afterburner effectively functions during low load engine operation, while the temperature is prevented from excessive elevation during medium and high load engine operation.

2. A method of cleaning exhaust gases from a multicylinder internal combustion engine comprising the steps of:

supplying a first air-fuel mixture richer than stoichiometric mixture into a first group of engine cylinders consisting of more than half the number of total cylinders of the engine and a second air-fuel mixture leaner than stoichiometric mixture into a second group of engine cylinders consisting of the remaining cylinders of the engine during low load engine operation;

supplying the first air-fuel mixture into the second group of engine cylinders and the second air-fuel mixture into the first group of engine cylinders during medium and high load engine operation; and afterburning in an afterburner the gases discharged from all the engine cylinders;

whereby the temperature in the reburning means is rapidly elevated so that the reburning means effectively functions during the low load engine operation, while the temperature is prevented from excessive elevation during medium and high load engine operation.

3. In a multicylinder internal combustion engine equipped with afterburner for afterburning gases from all the engine cylinders of the engine, the system comprising:

air-fuel mixture supply means for supplying air-fuel mixture into the engine cylinders;

actuating means operative to alternately take a first state in which said air-fuel mixture supply means supply a first air-fuel mixture richer than stoichiometric mixture into engine cylinders consisting of at least half the number of total engine cylinders and a second air-fuel mixture leaner than stoichiometric mixture into the remaining engine cylinders, and a second state in which said air-fuel mixture supply means supply the second air-fuel mixture into engine cylinders consisting of more than half the number of total engine cylinders and the first air-fuel mixture into the remaining engine cylinders; and control means for alternately generating a first signal during low load engine operation to put said actuating means into the first state and a second signal during medium and high load engine operations to put said actuating means into the second state;

whereby the engine discharges gases containing relatively high concentration of unburned constituents and thereafter the gases are introduced into the afterburner during low load engine operation so that the temperature in the afterburner is rapidly elevated to function effectively, while the engine discharges gases containing relatively low concentration of the unburned constituents and thereafter the gases are introduced into the afterburner during medium and high load engine operation so that the temperature is prevented from its excessive elevation.

4. In a multicylinder internal combustion engine having a first group of engine cylinders consisting of more than about half the number of total cylinders and a second group of engine cylinders consisting of remaining cylinders, equipped with afterburner for afterburning gases discharged from all the engine cylinders, the system comprising:

first and second air-fuel mixture supply means for supplying air-fuel mixture into the first and second groups of engine cylinders respectively;

actuating means operative to alternately take a first state in which said first air-fuel supply means supply a first air-fuel mixture richer than stoichiometric mixture and said second air-fuel supply means supply a second air-fuel mixture leaner than stoichiometric mixture, and a second state in which said first air-fuel supply means supply the second air-fuel mixture and said second air-fuel supply means supply the second air-fuel mixture; and control means for alternately generating a first signal during low load engine operation to put said actuating means into the first state and a second signal during medium and high load engine operations to put said actuating means into the second state;

whereby the engine discharges gases containing relatively high concentration of unburned constituents and thereafter the gases are introduced into the afterburner during low load engine operation so that the temperature in the afterburner is rapidly elevated to function effectively, while the engine discharges gases containing relatively low concentration of the unburned constituents and thereafter the gases are introduced into the afterburner during medium and high load engine operations so that the temperature is prevented from excessive elevation.

5. A system as claimed in claim 4, in which said first and second air-fuel mixture supply means include first and second carburetors, each of said carburetors including a main fuel passage connecting a float chamber to a main discharge nozzle and having a main jet therein, and an auxiliary fuel passage connecting upstream and downstream portions of the main jet in the main fuel passage and having an auxiliary jet therein.

6. A system as claimed in claim 5, in which said actuating means includes first and second electromagnetic flow control valves respectively combined with said first and second carburetors, each of said valves being operative to alternately be energized and de-energized to open and close respectively said auxiliary fuel passage of the corresponding carburetor in response to signals transmitted from said control means, and an inverter electrically connected to said first valve for inverting the signal transmitted from said control means.

7. A system as claimed in claim 6, further including a first amplifier electrically connecting said first flow control valve and said inverter, and a second amplifier electrically connected to said second flow control valve.

8. A system as claimed in claim 6, in which said control means includes a load sensor for sensing the engine load and generating an electrical signal responsive to the engine load, and a comparator electrically connecting said load sensor to the inverter and the second flow control valve of said actuating means and adapted to alternately generate a first logic signal for energizing solenoid valves of said actuating means when the electrical signal from the load sensor is lower than a predetermined level and a second logic signal for energizing the solenoid valves when the electrical signal is higher than the predetermined level.

9. A system as claimed in claim 4, in which said first and second air-fuel mixture supply means include a first and second group of fuel injection devices, each of said devices including a fuel injection nozzle for respectively injecting fuel into the intake port of the corresponding engine cylinder, and a solenoid valve controlling the flow to said corresponding nozzle.

10. A system as claimed in claim 9, in which said actuating means includes a first pulse generator for generating a pulse signal having relatively wide pulse width, a second pulse generator for generating another pulse signal having relatively narrow pulse width, and an electromagnetic relay operative to alternately connect said first pulse generator to said first air-fuel supply means and said second pulse generator to said second air-fuel supply means when the electromagnetic coil of said relay is energized, while connecting said first pulse generator to said second air-fuel supply means and said second pulse generator to said first air-fuel supply means when the electromagnetic coil is de-energized.

11. A system as claimed in claim 10, in which said control means includes an electronic computing circuit adapted to generate and transmit a signal responsive to the engine load to said first and second pulse generators for changing the pulse width of the pulse signal generated by said pulse generators in response to the signal from said computing circuit, and a control device electrically connecting to said electronic computing circuit and adapted to alternately generate the first signal for energizing the electromagnetic coil of said electromagnetic relay when the signal from said computing circuit is below a predetermined level while the second signal de-energizes said coil when the signal from the circuit is above the predetermined level.

12. A system as claimed in claim 3, in which said air-fuel mixture supply means further includes a first group of fuel injection devices for supplying fuel into a first group of engine cylinders consisting of less than half the number of total cylinders, a second group of fuel injection devices for supplying fuel into a certain number of engine cylinders and a third group of fuel injection devices for supplying fuel into engine cylinders consisting of about half the number of total engine cylinders, each of said devices having a fuel injection nozzle for injecting fuel into the corresponding intake port of said cylinder, and a solenoid valve controlling its corresponding nozzle.

13. A system as claimed in claim 12, in which said actuating means includes a first pulse generator for generating a pulse signal having a relatively wide pulse width electrically connecting to solenoid valves of said first group of fuel injection devices, a second pulse generator for generating another pulse signal having a relatively narrow pulse width electrically connected to the solenoid valves of said third group of fuel injection devices and an electromagnetic relay operative to alternately connect said first pulse generator to said second group of fuel injection devices when the coil of said relay is energized while connecting said second pulse generator to the second group of fuel injection devices when the coil of the relay is de-energized.

14. A system as claimed in claim 13, in which said control means includes an electronic computing circuit adapted to generate and transmit a signal responsive to the engine load to said first and second pulse generators for changing the pulse width of the pulse signal generated by said pulse generators in response to the signal from said computing circuit, and a control device electrically connected to said computing circuit and adapted alternately to generate the first signal for energizing the coil of said electromagnetic relay when the signal from said computing circuit is below a predetermined level while the second signal de-energizes the coil when the signal from said computing circuit is above said predetermined level.

* * * * *